US006034312A

United States Patent [19]

Lubell et al.

[11] Patent Number: 6,034,312

[45] Date of Patent: Mar. 7, 2000

[54] OPEN HOLE FLUTE PLUG WITH TACTILE AESTHETIC AND ACOUSTICAL PROPERTIES

[76] Inventors: Alex Lubell, 6622 North Bosworth, Chicago, Ill. 60626; Michael Blanchard, 1454 Lake Ave., Wilmet, Ill. 60091

[21] Appl. No.: 09/099,517

[22] Filed: Jun. 17, 1998

Related U.S. Application Data

[60] Provisional application No. 60/050,433, Jun. 18, 1997.

[51] Int. Cl.[7] ..... G10D 7/02

[52] U.S. Cl. ..... 84/384

[58] Field of Search ..... 84/384

[56] References Cited

U.S. PATENT DOCUMENTS

| | | | |
|---|---|---|---|
| 3,487,742 | 1/1970 | Mills . | |
| 3,767,506 | 10/1973 | Kawakami | 84/384 X |
| 5,339,719 | 8/1994 | Wasser . | |

*Primary Examiner*—Jeffrey Donels
*Attorney, Agent, or Firm*—Edward E. Sowers

[57] ABSTRACT

Novel plug devices having tactile and aesthetic properties are disclosed that effectively close the opening within a flute's open-hole key cup, simplify the fingering necessary to play the instrument and improve the instrument's tone, pitch and timbre. When installed near the key cup's upper surface, the key cup has the feel and appearance of a standard key cup. When installed deeper within the key cup, the key cup has the feel of an open-hole key cup.

20 Claims, 4 Drawing Sheets

OPEN HOLE FLUTE PLUG WITH TACTILE AESTHETIC AND ACOUSTICAL PROPERTIES

This application claims priority based on the provisional application filed on Jun. 18, 1997, having the same title and serial number 60/050,433. This provisional application is incorporated herein by this reference.

BACKGROUND

This invention relates generally to a plug device to effectively close the opening within a flute's open-hole key cup assembly and to cause the assembly to feel and have the appearance of a standard key cup assembly or alternately if the plug is more deeply inserted to have the feel of an open-hole assembly. Utilization of the novel plug additionally changes and improves an instrument's tone, pitch and timbre.

A flute is a cylindrical instrument having a closed end with an opening or mouthpiece adjacent to the closed end, a series of tone holes to one side of the mouthpiece, a series of pad or key cup assemblies positioned above the tone holes and capable of causing the tone holes to be either open or closed, and finally an open end opposite the mouthpiece. Standard flutes utilize pad or key cup assemblies having a pad assembly mounted within a cup and capable of covering and sealing the entire tone hole when depressed. Open hole flutes have standard key cup assemblies and up to five (5) open hole pad and key cup assemblies with channels centrally located within the pad and key cup which additionally require the performer to cover the channel with a finger to effect closure of the tone hole.

Although open-hole flutes are generally preferred by more experienced and professional musicians, the required fingering is difficult for young musicians with small hands, inexperienced musicians and more experienced musicians lacking dexterity due to injury or disease. Musicians unable to play an open hole flute have attempted to solve this problem by placing small disks constructed of cork, plastic or rubber within the channel of the open hole pad assembly to simplify the additional fingering normally required. Such closures have proven unsatisfactory because of design and materials of construction. Closures that protrude above the pad assembly adversely affect the pad cup's feel and appearance and make difficult the natural finger position needed for proper hand position. Cork closures lack elasticity and over time become compressed, fit loosely within the channel, allow air to leak at its interface and finally work loose becoming detached from the pad assembly. Plastic and rubber closures degrade over time due to the loss of plasticizers and oxidation from exposure to air. As a result they can become brittle and fail to provide an adequate seal. Finally, all of the closures currently available lack the feel of a finished or metal surface and detract from the appearance of the polished silver, gold, or platinum instrument. For the foregoing reasons, a closure is needed that can, with repeated use, securely close the channel within an open hole pad assembly, enhance the instrument's appearance and be positioned to either maintain the natural finger position needed for proper hand position on an open hole flute or cause the upper surface of the pad assembly to look and feel like the metal surface of a standard key cup assembly.

SUMMARY

As will become apparent from the following discussion, the present invention is directed to an open hole flute plug which can, with repeated use, securely close the channel within an open hole key cup assembly and depending on its location within the key cup's channel cause the upper surface of the assembly to feel like either a standard or open hole key cup assembly. When placed within the upper portion of a key cup's channel to provide a level surface, the novel plug simplifies necessary fingering and enhances the instrument's appearance. When placed lower within a key cup's channel, the novel plug simplifies necessary fingering, provides the feel of an open hole instrument, and aids students in learning the fingering technique necessary to play an open hole instrument without the use of any plugs. Surprisingly, open hole flutes utilizing the present invention have demonstrated improved tone, pitch and timbre qualities.

An open hole flute plug having features of the present invention comprises a disc-shaped device having a rigid central member with an annular edge, a flexible outer member having inner and outer annular edges and means for securing the inner annular edge of the flexible member to the annular edge of the rigid member. One edge of the rigid central member is a generally planar surface finished to provide a pleasing visual and tactile surface. The second edge of the rigid central member can be planar or non-planar having a surface with one or more cavities or projections. Suitable materials for constructing the rigid member include a variety of metals, wood, ceramics, stone, porcelain, clay and polymeric materials. Suitable materials for constructing the outer flexible member include a variety of natural and synthetic rubbers and plastics.

Preferred surfaces having tactile and aesthetic properties can be obtained by finishing the rigid member's surface with a coating such as paint, lacquer or polymeric material or by plating the rigid member with a metal such as silver or gold. For plugs having a rigid member made of silver or other precious metal, the decorative surface can be obtained by simple polishing.

The preferred flute plug's diameter is slightly greater than the channel within the open hole key cup assembly and is typically less than about 0.4 of an inch. Compression of the flexible outer member allows the plug to be inserted into the tone hole and remain therein. Should the outer flexible member become damaged or deteriorate over time, it can be replaced with an new flexible member restoring the plug to its original state.

For one embodiment of the present invention, means for securing the inner annular edge of the flexible outer member to the annular edge of the rigid member includes an adhesive material. Choice of the adhesive depends on the materials of construction for the rigid central member and the flexible outer member. Adhesives which have proven particularly suitable include epoxy resins, cyanoacrylates, and a variety of contact cements. For a preferred embodiment of the present invention, means for securing the flexible outer member to the annular edge of the rigid member includes a groove within the central members annular edge to contain a stretched flexible outer member comprising an o-ring or modified o-ring. Should the o-ring or modified o-ring be damaged or degrade over time, its replacement with a new and inexpensive o-ring or modified o-ring renews the plug to its original condition.

DRAWINGS

These and other features, aspects, and advantages of this invention will become better understood with regard to the following description, appended claims and accompanying drawings where:

FIG. 1 shows a top view of the rigid central member

FIG. 2*a* shows a lateral view of a rigid central member having a polished surface and a flat annular edge.

FIG. 2*b* shows a lateral view of a rigid central member having a surface coating and an annular groove.

FIG. 3 shows a top view of an flexible outer member.

FIG. 4*a* shows a lateral view of a flexible outer member having a circular cross-section.

FIG. 4*b* shows a lateral view of a flexible outer member having a rectangular cross-section.

FIG. 5*a* shows a top view of an open-hole flute plug comprising a rigid central member having an outer annular edge, an outer flexible member having a rectangular cross-section, and an adhesive layer between the rigid central member and the flexible outer member, bonding the members to each other.

FIG. 5*b* shows a lateral view of the open-hole flute plug in FIG. 5*a*.

FIG. 6*a* shows a top view of an open-hole flute plug comprising a rigid central member having a decorative surface and an annular groove within its annular surface and an outer flexible member secured within the rigid central member's annular groove.

FIG. 6*b* shows a lateral view of the open-hole flute plug in FIG. 6*a*

DESCRIPTION

Figure 1:
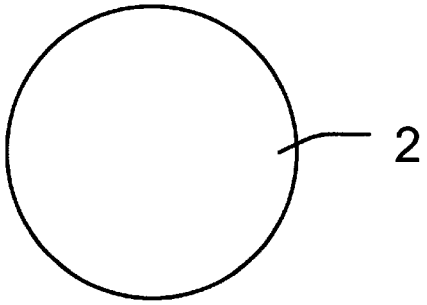

For the purposes of promoting an understanding of the principles of this invention, references will now be made to several embodiments and specific language will be used to describe the same. It will nevertheless be understood that no limitation of the scope of the invention is thereby intended, such alterations and further modifications and applications of the principles of the invention as described herein being contemplated as would normally occur to one skilled in the art to which the invention relates.

As used herein and illustrated in FIGS. 1 through 8, the term decorative surface refers to a surface that has been plated, polished, or coated with a thin layer of a paint, lacquer or other coating. Generally planar refers to a surface that is either planar or closely approximates a planar surface with raised or depressed regions of less than about 0.060 of an inch. Concave or convex surfaces within these limits are considered generally planar. As used herein and illustrated in FIGS. 4*b*, 5*b*, 6*b*, and 8, the term o-ring includes standard and modified o-rings where a modified o-ring refers to an o-shaped ring having a square or rectangular cross section.

This invention relates to novel open-hole flute plugs that effectively close the opening or channel within a flute's open-hole key cup assembly, provide tactile and aesthetic properties and improve the instrument's tone and pitch. Depending on the plug's position within the open-hole key cup, the cup can be made to have the feel of a standard or open-hole key cup assembly.

The novel plugs are disc shaped devices having a rigid central member, a flexible outer member, means for securing the flexible outer member to the rigid central member. The plug's overall diameter is slightly greater than the channel within a flute's open-hole key cup assembly. Means for securing the flexible outer member to the rigid central member can include an adhesive layer or an annular groove within the annular edge of the rigid central member. The shape, height and depth of the annular groove can vary and generally depends on the shape, height and thickness of the flexible outer member chosen. The groove's only requirements are that its depth be sufficient to secure the flexible outer member in place. Annular grooves in plugs tested have typically had heights and depths ranging from about 0.02 to 0.10 of an inch. Typically, a plug's diameter will be less than 0.4 of an inch, preferably between 0.200 to 0.350 of an inch and its thickness will typically be less than 0.25 of an inch, preferably between 0.10 and 0.18 of an inch. The distance between the inner and outer annular edges of the flexible outer member can vary depending on the depth of the groove within the outer annular edge of the rigid central member. The flexible outer member is sized to fit within the rigid central member's annular groove and extend beyond the rigid central member's outer annular edge sufficiently to cause the plug's diameter to be compressed when placed within an open-hole key cup and to cause it to remain in place. Generally the flexible outer member's extension beyond the rigid central member's outer annular edge accounts for about 2 to 30% of the plugs overall diameter.

Figure 2A:
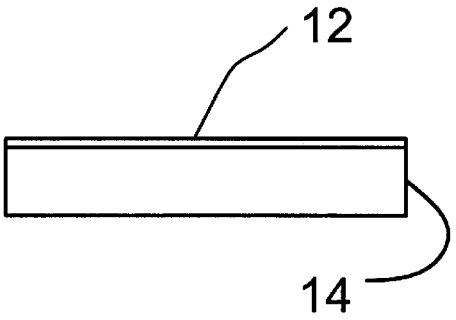
Figure 2B:
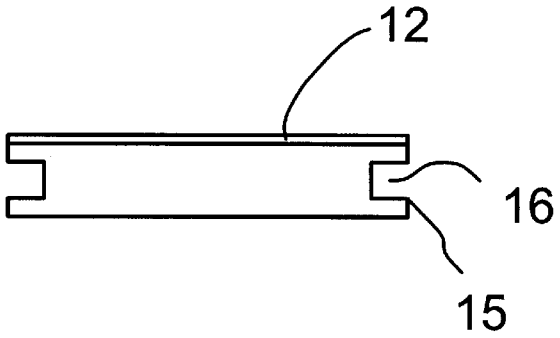

A more detailed description of the invention follows and refers to the appended drawings. FIG. 1 illustrates a top view of a preferred rigid central member 2. Cross-sectional views of two embodiments of the rigid central member shown in FIG. 1 are illustrated in FIGS. 2*a* and 2*b*. FIG. 2*a* illustrates the rigid members generally planar and decorative surfaces 12 and a cylindrical annular edge 14 suitable for bonding to the outer flexible member with an adhesive. FIG. 2*b* further illustrates an annular edge 15 having a groove 16 suitable for securing an o-ring or modified o-ring to the rigid central member with or without an adhesive.

The rigid member 2 can be constructed from a hard plastic, wood, ceramics, stone, porcelain, clay or a metal by carving, grinding, machining or molding in the case of plastics with a sufficiently low softening point. Central members made from plastic, wood or metal can be formed by cutting rod stock having the appropriate diameter to give the desired thickness. If desired, grooves can be cut or machined in the rod stock prior to or after forming the disc. Plastics which have proven particular suitable include polyoxymethylene (acetal); copolymers of acrylonitrile, butadiene and styrene; polyvinylchloride; nylon; acrylics, polytetrafluoroethylenes, polyimides, polycarbonates and phenolics. Although hardwoods have been the preferred wood, any wood resistant to splitting can be used. Metals successfully utilized include silver, gold and non-ferrous metals such as brass, copper, aluminum, zinc and nickel.

Depending on the material chosen for the rigid central member, cost of the open-hole plug, and marketing factors, the decorative surface can be formed by polishing, plating or coating the generally planar surface. For student plugs, a plastic central member having a decorative coating of paint, lacquer or other coating with or without added designs is preferred. For more experienced musicians, a non-ferrous metal central member having a surface plated with silver or gold or gold or silver central member having a polished surface is preferred. The coating, plating and polishing techniques required are known and commonly used by skilled artisans. Unlike the upper surface of cork and rubber plugs, the decorative surfaces formed by polishing, plating or coating the rigid central member provide a pleasant touch resembling the upper surface of a regular key cup and has proven desirable by musicians.

Figure 3:
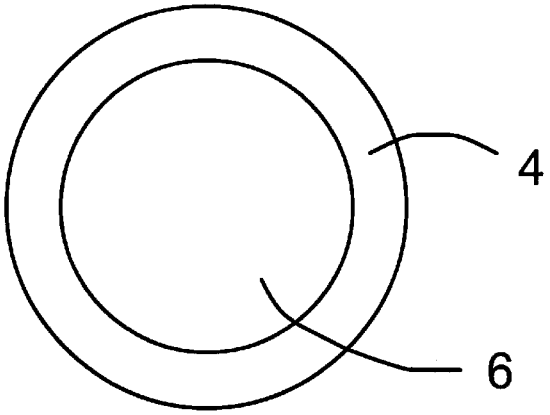
Figure 4A:
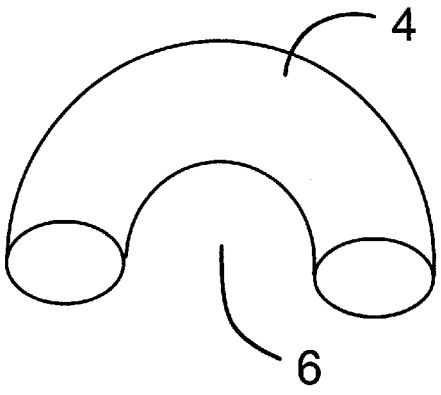
Figure 4B:
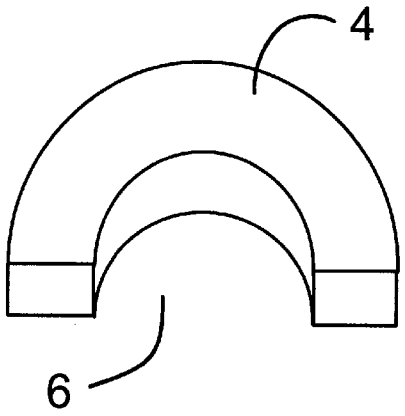

FIG. 3 illustrates a top view of the outer flexible member 4 having a central cavity 6. Cross-sectional views of one embodiment of the outer flexible member in FIG. 4*a* illustrates a flexible outer member having a curved annular edge and a circular cross section. The cross-sectional view of another embodiment of the outer flexible member in FIG. 4*b* illustrates a flexible outer member having a cylindrical annular edge and a rectangular cross-section. Both flexible outer members are suitable for being secured to the rigid central member with an adhesive or within an annular groove.

Although the flexible outer member can be made from any flexible material capable of forming the required shape and either being bonded with an adhesive to the outer annular edge of the rigid central member or being stretched to allow placement into a groove on the outer annular edge of the rigid outer member, polymeric materials have been preferred. Suitable polymeric materials include a rubber material such as natural rubber, butyl rubber, silicon rubber and copolymers of vinylidene fluoride and hexafluoropropylene; nylons; tetrafluoroethylenes; and copolymers of vinylacetate and chloroethene. The outer member can be a commercially available o-ring available in a variety of materials or made from commercially available o-ring material utilizing a cyanoacrylate or other adhesive to bond the linear material into a circular or o-form. Modified o-rings can be obtained by selecting tubing constructed of an appropriate material and having an appropriate inner and outer diameter and cutting cross-sections of the tubing to form the modified o-ring having the desired thickness.

Adhesives for securing the flexible outer member to the rigid central member should be chosen to be compatible with the materials of construction used to make the inner and outer members. Epoxy resins, urethanes, cyanoacrylates, and a variety of contact cements have proven satisfactory for binding a wide variety of materials.

Figure 5A:
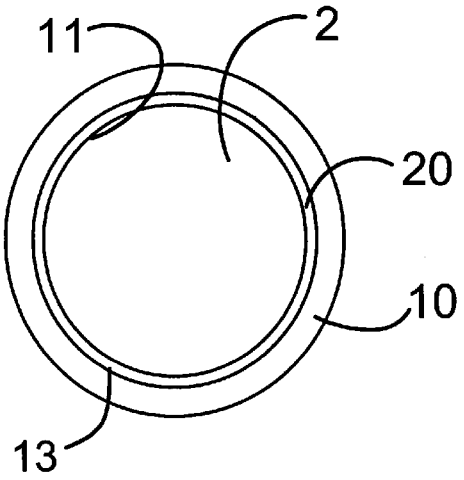
Figure 5B:
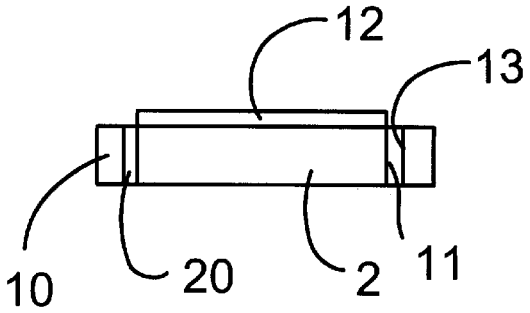

FIGS. 5*a*, 5*b*, 6*a*, 6*b*, 7, and 8 illustrate several embodiments of the novel open-hole flute plugs. FIGS. 5*a* and 5*b* illustrate top and cross-sectional views of an assembled plug with a rigid central member 2 having a cylindrical outer annular edge 11 and a generally planar and decorative surface 12; a flexible outer member 10 having a cylindrical inner annular edge 13 and a rectangular cross-section; and an adhesive layer 20 to secure the flexible outer member to the inner rigid member.

Figure 6A:
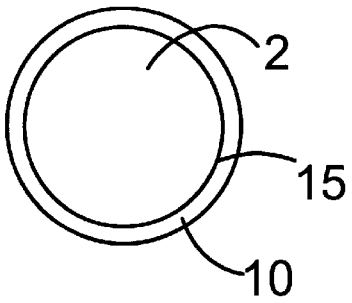
Figure 6B:
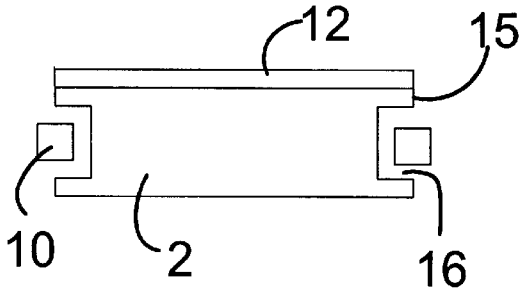

FIGS. 6*a* and 6*b* illustrate top and cross-sectional views of an assembled plug having a flexible outer member 10, a rigid central member 2 having an outer annular edge 15, the outer annular edge containing an annular groove 16 to secure the flexible outer member. The shape of the annular groove 16 preferably corresponds to the shape of the flexible outer member 10 and allows the flexible member 10 to fit snugly within the annular groove and protrude beyond the outer annular edge of the rigid member 10. For preferred embodiments, the flexible member protrudes at least about 0.005 of an inch beyond the rigid member's annular edge.

Figure 7:
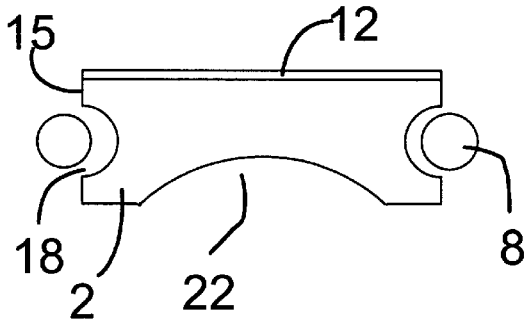
FIG. 7 shows a lateral view of an open-hole flute plug comprising a rigid central member having a decorative surface and an annular groove, the groove's wall forming a curved lateral surface and an outer flexible member comprising an o-ring secured within the rigid central member's annular groove.

FIG. 7 illustrates a cross-sectional view of an assembled plug with a rigid central member 2 having an outer annular edge 15, an annular groove 18 within its annular edge, a decorative surface 12, and a depression or cavity 22 within one of its surfaces and an outer flexible member having a circular cross-section secured within the rigid central member's annular groove. The shape of the annular groove 18 corresponds to the shape of the flexible outer member 8 and allows the flexible member 10 to protrude beyond the rigid member's outer annular edge 15.

Figure 8:
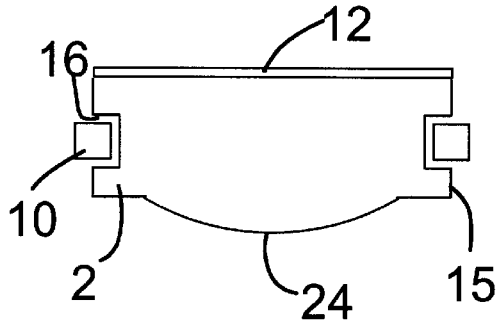
FIG. 8 shows a lateral view of the open-hole flute plug comprising a rigid central member having a decorative surface and an annular groove, the groove's walls forming right angles with each other and an outer flexible member having a square cross-section, the flexible member secured within the rigid central member's annular groove.
Figure 9:
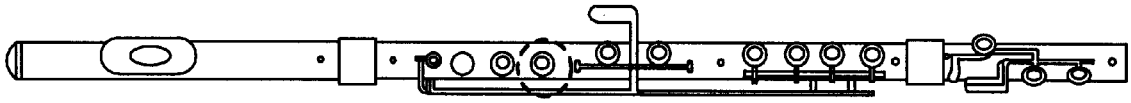
FIG. 9 shows an open hole flute having the open hole flute plug illustrated in FIGS. 6*a* and 6*b* inserted into an open hole key cup 30.
Figure 10:
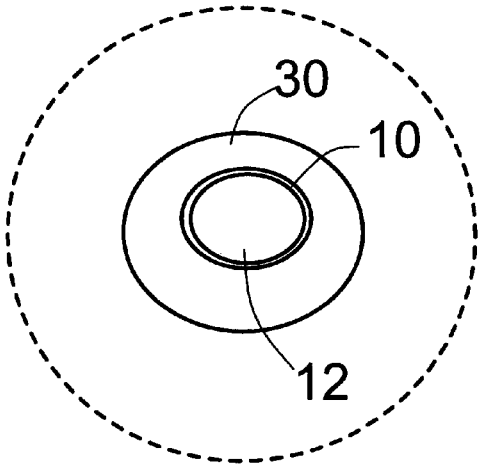
FIG. 10 shows an enlarged view of an open hole key cup 30 fitted with the open hole flute plug.
Figure 11:
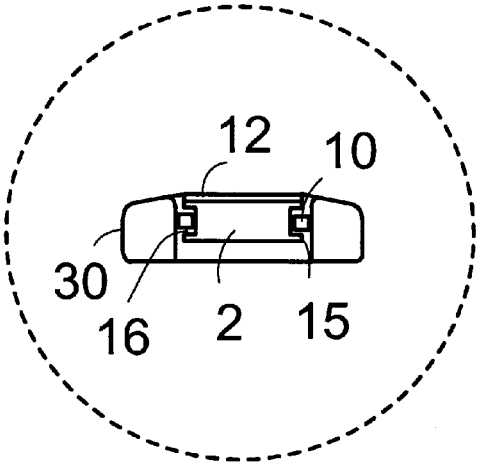
FIG. 11 shows a lateral view of the key cup and flute plug in FIG. 10.

FIG. 8 illustrates a cross-sectional view of a modification of the assembled plug illustrated in FIG. 6*b* wherein the rigid central member has at least one projection 24 on one of its surfaces and the flexible outer member has a square cross-section. The projection 24 illustrated in FIG. 8 and the depression 22 illustrated in FIG. 7 located on one of the rigid central member's surface can be machined or cut into the surface after the member is formed or formed during molding of the member from a moldable plastic.

The novel open-hole flute plugs can be inserted into the cavity of an open-hole key cup with slight pressure. If the feel of a standard key cup is desired, the plug is positioned so that the plugs surface is flush with the upper surface of the key cup. If the feel of an open-hole key cup is desired, the plug is inserted further into the cavity within the open-hole key cup. Removal of the plug only requires a slight pressure from either side of the key cup.

Flutes equipped with the novel open hole flute plugs described herein are capable of securely closing the channels within a flute's open-hole key cup; can provide either the feel of a standard key cup or an open-hole key cup to assist beginning students; can improve the instrument's tone, pitch and timbre; and can improve the appearance of the instrument. In addition, the novel plugs can, if damaged, be renewed to their original condition by simple replacement of the outer flexible region.

The following Examples illustrate the improved pitch and tone obtained with the novel open-hole flute plugs.

EXAMPLE 1

A series of notes were played on a Haynes Low B open-hole flute by an experienced flutist and each note's pitch determined utilizing a KROG Model DT-10 tuner KORG is a registered trademark of Korg, Inc., Tokyo, Japan. Deviations from true pitch in one hundredths (0.01) of a semitone were recorded. During the performance, the tuner was positioned to prevent the flutist from observing the results from each measurement. Open-hole flute plugs corresponding to FIGS. 4*a* and 4*b* having a rigid central region constructed of brass and having a flexible outer region comprising a modified o-ring made of polychloroprene were placed in each of the instrument's open-hole key cups and the performance repeated by the same flutist. Again deviations from the true pitch were measured and recorded. Without the novel open-hole plugs, notes within the higher range tended to be sharp, notes within the middle range were on or nearly on pitch and notes within the lower range were generally flat. With the flute plugs, the high notes were less sharp and the low notes were less flat. Test results are shown below in Table I.

TABLE I

| Note | without plug (0.01 semitone) | with plug (0.01 semitone) |
|---|---|---|
| $C^3$ | +2 | +2 |
| B | +2 | +1 |
| $B^b$ | +2 | +1 |
| A | +1 | 0 |
| $A^b$ | +1 | 0 |
| G | +1 | +2 |
| $G^\#$ | 0 | 0 |
| F | 0 | 0 |
| E | 0 | +1 |
| $E^b$ | 0 | +1 |
| D | +2 | +1 |
| $D^b$ | +2 | +3 |
| $C^2$ | +1 | +2 |
| B | 0 | 0 |
| $B^b$ | +1 | 0 |
| A | +1 | −1 |
| $A^b$ | 0 | 0 |
| G | −1 | 0 |
| $G^b$ | 0 | −1 |
| F | −1 | 0 |
| E | −2 | −1 |
| $E^b$ | −2 | −1 |
| D | −2 | 0 |
| $D^b$ | −2 | 0 |
| $C^1$ | −2 | 0 |

"+" denotes higher than the true pitch and "−" denotes lower than the true pitch

EXAMPLE 2

The method utilized in Example 1 was repeated with an Armstrong Model 80B open-hole flute to give similar results illustrated in Table II.

TABLE II

| Note | without plug (0.01 semitone) | with plug (0.01 semitone) |
|---|---|---|
| $C^3$ | +2 | +1 |
| $C^\#$ | +2 | +1 |
| D | +2 | +1 |
| A | +3 | +1 |
| E | +2 | +2 |
| F | +2 | +2 |
| $F^\#$ | +2 | +1 |
| $B^\#$ | +1 | 0 |
| A | 0 | 0 |
| $A^\#$ | −1 | 0 |
| D | 0 | 0 |
| B | +2 | +1 |
| $C^2$ | 0 | +1 |
| $C^\#$ | 0 | +1 |
| D | 0 | 0 |
| $D^\#$ | 0 | 0 |
| E | 0 | 0 |
| F | 0 | 0 |
| $F^\#$ | −1 | 0 |
| G | −2 | −1 |
| $G^\#$ | −2 | −1 |
| A | −2 | −1 |
| $A^b$ | −2 | 0 |
| B | −2 | 0 |
| $C^1$ | −2 | 0 |

"+" denotes higher than the true pitch and "−" denotes lower than the true pitch

EXAMPLE 3

Scales were played by an experience flutist with and without the open-hole flute plugs inserted in the open-hole key cups. Four (4) musicians listened to the scales without being able to observe the flutist. In each instance, the musician judged the overall tone and timbre better for the performance utilizing the novel open-hole flute plugs.

What is claimed is:

1. An open-hole flute plug having tactile, aesthetic and acoustical properties comprising a disc-shaped device having a diameter of less than 0.4 of an inch, the device further having:

a) a rigid central member having an annular edge and at least one generally planar and decorative surface;

b) a flexible outer member having inner and outer annular edges;

c) means for securing the inner annular edge of the flexible outer member to the annular edge of the rigid member.

2. The open-hole flute plug in claim 1, wherein the means for securing comprises an adhesive layer intermediate between the inner annular edge of the flexible member and the outer annular edge of the rigid member.

3. The open-hole flute plug in claim 2, wherein the rigid central member is metal and the flexible outer member is a polymer selected from the group consisting of natural rubber; butyl rubber; silicon rubber; a copolymer of vinylidene fluoride and hexafluoropropylene and a copolymer of vinyl acetate and chlorethane.

4. The open-hole flute plug in claim 2, wherein the rigid central member is plastic.

5. The open-hole flute plug in claim 1, wherein the means for securing comprises an annular groove within the annular edge of the rigid central member and the flexible outer member is an o-ring.

6. The open-hole flute plug in claim 5, wherein the rigid central member is a hard plastic selected from the group consisting of polyoxymethylene (acetal); copolymers of acrylonitrile, butadiene and styrene; polyvinylchloride; nylon; acrylics; polytetrafluoroethylenes; polyimides; polycarbonates and phenolics.

7. The open-hole flute plug in claim 5, wherein the rigid central member is metal.

8. The open-hole flute plug in claim 7, wherein the metal and the decorative surface are sterling silver.

9. The open-hole flute plug in claim 7, wherein the metal is a non-ferrous metal selected from the group consisting of brass, copper, aluminum, zinc, and nickel.

10. The open-hole flute plug in claim 9, wherein the o-ring is a polymer selected from the group consisting of natural rubber; butyl rubber; silicon rubber; copolymers of vinylidene fluoride and hexafluoropropylene; nylons; tetrafluoroethylenes; and copolymers of vinylacetate and chloroethene.

11. The open-hole flute plug in claim 9, wherein the o-ring is a copolymer of vinylidene fluoride and hexafluoropropylene.

12. The open-hole flute plug in claim 10 wherein the decorative surface is a layer of a metal selected from the group consisting of silver and gold.

13. The open-hole flute plug in claim 10 wherein the decorative surface is is a coating selected from the group consisting of paint and lacquer.

14. The open-hole flute plug in claim 6, wherein the rigid central member is a plastic and the o-ring is a copolymer of vinylidene fluorided and hexafluoropropylene.

15. The open-hole flute plug in claim 14, wherein the decorative coating is a coating selected from the group consisting of paint and lacquer.

16. The open-hole flute plug in claim 1, the rigid central member having at least one depression within one surface.

17. The open-hole flute plug in claim 1, the rigid central member having at least one projection upon one surface.

18. An open hole flute having at least one open hole flute plug fitted within an open hole key cup wherein the open hole flute plug comprises:

a) a rigid central member having an annular edge and at least one generally planar and decorative surface;

b) a flexible outer member having inner and outer annular edges; and c) means for securing the inner annular edge of the flexible outer member to the annular edge of the rigid member.

19. The open hole flute in claim 18, wherein the means for securing comprises an annular groove within the annular edge of the rigid central member and the flexible outer member is an o-ring.

20. The open hole flute in claim 18, wherein the means for securing comprises an adhesive layer intermediate between the inner annular edge of the flexible outer member and the outer annular edge of the rigid central member and the flexible member is an o-ring.

* * * * *